US010634038B2

(12) United States Patent
Lee

(10) Patent No.: US 10,634,038 B2
(45) Date of Patent: Apr. 28, 2020

(54) COOLANT CONTROL VALVE AND A COOLING SYSTEM HAVING SAME

(71) Applicants: HYUNDAI MOTOR COMPANY, Seoul (KR); KIA MOTORS CORPORATION, Seoul (KR)

(72) Inventor: Yonggyu Lee, Suwon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 216 days.

(21) Appl. No.: 15/827,540

(22) Filed: Nov. 30, 2017

(65) Prior Publication Data

US 2019/0120121 A1 Apr. 25, 2019

(30) Foreign Application Priority Data

Oct. 24, 2017 (KR) ..... 10-2017-0138368

(51) Int. Cl.
*F01P 7/16* (2006.01)
*F01P 3/02* (2006.01)
*F01P 7/14* (2006.01)

(52) U.S. Cl.
CPC ..... *F01P 7/165* (2013.01); *F01P 3/02* (2013.01); *F01P 2003/027* (2013.01); *F01P 2003/028* (2013.01); *F01P 2007/146* (2013.01); *F01P 2025/08* (2013.01); *F01P 2025/32* (2013.01); *F01P 2031/00* (2013.01)

(58) Field of Classification Search
CPC ..... F01P 7/165; F01P 7/00; F01P 3/02; F01P 3/12; F01P 2003/027; F01P 2003/028; F01P 2007/146; F01P 2025/32; F01P 2025/08; F01P 2031/00; B60K 11/02
See application file for complete search history.

(56) References Cited

U.S. PATENT DOCUMENTS 5,657,722 A * 8/1997 Hollis ..... F01P 7/167 123/41.08
9,429,064 B2 * 8/2016 Nagahama ..... F01P 7/16
9,752,493 B2 * 9/2017 Malone ..... F01P 7/14
(Continued)

FOREIGN PATENT DOCUMENTS

KR 1020100117909 11/2010

*Primary Examiner* — Grant Moubry
(74) *Attorney, Agent, or Firm* — Lempia Summerfield Katz LLC

(57) ABSTRACT

A coolant control valve unit includes a valve housing. The valve housing includes a first coolant supply passage and a second coolant supply passage, a coolant chamber in which coolant supplied through the first and second supply passages gathers, a first distribution passage and a second distribution passage being distributed from the coolant chamber to coolant components, and a bypass passage bypassing the first distribution passage. The coolant control valve unit also includes first and second valves disposed to open and close the first distribution passage and the second supply passage, a thermostat of a temperature sensitive type installed at the bypass and operating by a coolant temperature, a valve operator controlling movement of the first and second valves, respectively, and a wall formed at one side of the thermostat and in which a cooling passage is formed such that the coolant flows from the coolant supply passage to the second distribution passage.

16 Claims, 3 Drawing Sheets

(56) References Cited

U.S. PATENT DOCUMENTS

| | | | | |
|---|---|---|---|---|
| 10,072,556 | B2 * | 9/2018 | Maruyama | F01P 7/16 |
| 10,287,968 | B2 * | 5/2019 | Kaneko | F01P 7/14 |
| 2012/0048411 | A1 * | 3/2012 | Steyer | F16K 11/0856 137/625 |
| 2013/0221116 | A1 * | 8/2013 | Tsuchiya | F01P 7/14 236/34.5 |
| 2013/0276727 | A1 * | 10/2013 | DiPaola | F01P 7/165 123/41.08 |
| 2015/0176471 | A1 * | 6/2015 | Hutchins | F01P 7/16 236/34.5 |
| 2015/0184576 | A1 * | 7/2015 | Yi | F01P 3/02 123/41.09 |
| 2015/0267603 | A1 * | 9/2015 | Ichihara | F01P 11/16 236/34.5 |
| 2016/0109890 | A1 * | 4/2016 | Styron | F01P 7/16 236/34.5 |
| 2016/0273671 | A1 * | 9/2016 | Chang | F01P 7/14 |
| 2018/0119836 | A1 * | 5/2018 | Ozeki | F01P 3/18 |

* cited by examiner

COOLANT CONTROL VALVE AND A COOLING SYSTEM HAVING SAME

CROSS-REFERENCE TO RELATED APPLICATION

This application claims priority to and the benefit of Korean Patent Application No. 10-2017-0138368 filed in the Korean Intellectual Property Office on Oct. 24, 2017, the entire contents of which are incorporated herein by reference.

BACKGROUND OF THE DISCLOSURE

(a) Field of the Disclosure

The present disclosure relates to a coolant control valve and a cooling system having the coolant control valve that can improve overall cooling efficiency and reduce fuel consumption by controlling a coolant supplied to a radiator, a heater, an oil cooler, and the like.

(b) Description of the Related Art

Engines produce torque by burning a fuel to create engine combustion and discharge combusted gas. More particularly, an engine absorbs thermal energy as the thermal energy circulates through an engine, and releases the thermal energy.

Oil becomes highly viscous at low engine coolant temperatures. With thick oil, friction and fuel consumption increase. Also, the time taken for catalyst activation becomes lengthened and exhaust gas quality may be deteriorated.

When the engine coolant temperature is excessively high, knocking may occur. If ignition timing is adjusted to suppress knocking, the engine performance may be degraded. In addition, excessive lubricant temperatures may result in poor lubrication.

However, one coolant control valve unit is used in specific regions of an engine. The one coolant valve unit controls a number of cooling elements, such as keeping the coolant at high temperatures and other regions at low temperatures.

This coolant control valve unit controls coolant circulating the engine (the oil cooler, the heater, an EGR cooler, and the like) and the radiator, respectively, to improve overall cooling efficiency and reduce fuel consumption.

Accordingly, a temperature of the coolant at a predetermined position is detected by using a coolant temperature sensor. A target coolant temperature is set according to a driving condition. The coolant control valve unit is controlled according to the target coolant temperature.

Meanwhile, if the coolant control valve unit does not operate, a passage at the radiator is closed, which overheats the coolant. Accordingly, a bypass passage is formed toward the radiator and a fail-safe valve (such as a wax type thermostat) is installed at the bypass passage.

Further, a water passage may be formed for flowing of the coolant to improve temperature sensitivity of the fail-safe valve, but the coolant circulates toward the radiator to delay warm-up time. Accordingly, research has been carried out for ways to not delay the warm-up time and to improve temperature sensitivity of the fail-safe valve. See, for example, Korean Laid Open Patent Publication No. 10-2010-0117909.

The above information disclosed in this Background section is only for enhancing the understanding of the background of the disclosure. Therefore, the Background section may contain information that does not form the prior art that is already known in this country to a person of ordinary skill in the art.

SUMMARY OF THE DISCLOSURE

The present disclosure is made in an effort to provide a coolant control valve unit and a cooling system having the coolant control valve unit, which prevents overheating of the coolant in advance and improves temperature sensitivity of a fail-safe valve while not delaying warm-up time.

A coolant control valve unit according to an embodiment of the present disclosure includes a valve housing in which a first supply passage and a second supply passage are formed that supply coolant. The valve housing includes a coolant chamber in which coolant supplied through the first and second supply passages gathers, a first distribution passage and a second distribution passage being distributed from the coolant chamber to coolant components, and a bypass passage bypassing the first distribution passage. The coolant control valve unit further includes: first and second valves disposed to open and close the first distribution passage and the second supply passage; a thermostat of a temperature sensitive type installed at the bypass and operating by a coolant temperature; a valve operator controlling movement of the first and second valves, respectively; and a wall formed at one side of the thermostat and in which a cooling passage is formed such that the coolant flows from the coolant supply passage to the second distribution passage.

The thermostat may include a cooling portion filled with wax, the wax contracting and expanding according to a temperature of the coolant. The cooling passage may be formed at a position corresponding to the cooling portion.

The first distribution passage and the bypass passage may be formed at one side of the wall. The second distribution passage and the second supply passage may be formed at the other side of the wall.

The thermostat may be disposed on an upper portion of the other side of the first supply passage. The wall may be formed at the other side of the thermostat. The second distribution passage may be formed at an upper portion of the other side of the wall.

The second distribution passage may include a coolant control valve unit formed at the valve housing at a predetermined distance opposite the second supply passage.

A cooling system according to an embodiment of the present disclosure includes a valve housing in which a head coolant supply passage to which coolant exhausted from a cylinder head is supplied. The valve housing includes a block coolant supply passage to which coolant exhausted from a cylinder block is supplied, a coolant chamber in which coolant supplied through the cylinder head and the cylinder block gathers, a first distribution passage and a second distribution passage being distributed from the coolant chamber to coolant components, and a bypass passage bypassing the first distribution passage. The cooling system further includes first and second valves disposed to open and close the first distribution passage and the block coolant supply passage; a thermostat of a temperature sensitive type installed at the bypass and operating by a coolant temperature; a valve operator controlling movement of the first and second valves, respectively; and a wall formed at one side of the thermostat and in which a cooling passage is formed such that the coolant flows from the coolant supply passage to the second distribution passage.

The thermostat may include a cooling portion filled with wax, the wax contracting and expanding according to a temperature of the coolant. The cooling passage may be formed at a position corresponding to the cooling portion.

The first distribution passage and the bypass passage may be formed at one side of the wall. The second distribution passage and the block supply passage may be formed at the other side of the wall.

The thermostat may be disposed on an upper portion of the other side of the head coolant supply passage. The wall may be formed at the other side of the thermostat. The second distribution passage may be formed at an upper portion of the other side of the wall.

The second distribution passage may include a coolant control valve unit formed at the valve housing at a predetermined distance opposite the block coolant supply passage.

A cooling system according to an embodiment of the present disclosure includes a valve housing in which a head coolant supply passage to which coolant exhausted from a cylinder head is supplied. The valve housing includes a block coolant supply passage to which coolant exhausted from a cylinder block is supplied, a coolant chamber in which coolant supplied through the cylinder head and the cylinder block gathers, a first distribution passage, a second distribution passage, and a third distribution passage being distributed from the coolant chamber to coolant components, and a bypass passage bypassing the first distribution passage. The cooling system further includes first, second, and third valves disposed to open and close the first distribution passage, the block coolant supply passage, and the third distribution passage; a thermostat of a temperature sensitive type installed at the bypass and operating by a coolant temperature; a valve operator controlling movement of the first, second, and third valves, respectively; and a wall formed at one side of the thermostat and in which a cooling passage is formed such that the coolant flows from the coolant supply passage to the second distribution passage.

The thermostat may include a cooling portion filled with wax, the wax contracting and expanding according to a temperature of the coolant. The cooling passage may be formed at a position corresponding to the cooling portion.

The first distribution passage and the bypass passage may include a coolant control valve unit connected with a radiator.

The second distribution passage may include a coolant control valve unit connected with an oil cooler.

The third distribution passage may include a coolant control valve unit connected with a heater core or a low pressure EGR cooler.

The first distribution passage, the third distribution passage, and the bypass passage may be formed at one side of the wall. The second distribution passage and the block supply passage may be formed at the other side of the wall.

The thermostat may be disposed on an upper portion of the other side of the head coolant supply passage. The wall may be formed at the other side of the thermostat. The second distribution passage may be formed at an upper portion of the other side of the wall.

The second distribution passage may include a coolant control valve unit formed at the valve housing at a predetermined distance opposite the block coolant supply passage.

According to an embodiment of the present disclosure, temperature sensitivity of the fail-safe valve may be improved by forming a temperature sensing passage at the wall formed at one side of the fail-safe valve.

Also, stability of the coolant control valve unit and the whole cooling system may be improved in an overheated condition of the coolant in a state that the valve is fixed or stuck by improving the temperature sensitivity of the fail-safe valve.

DETAILED DESCRIPTION OF THE EMBODIMENTS

Figure 1:
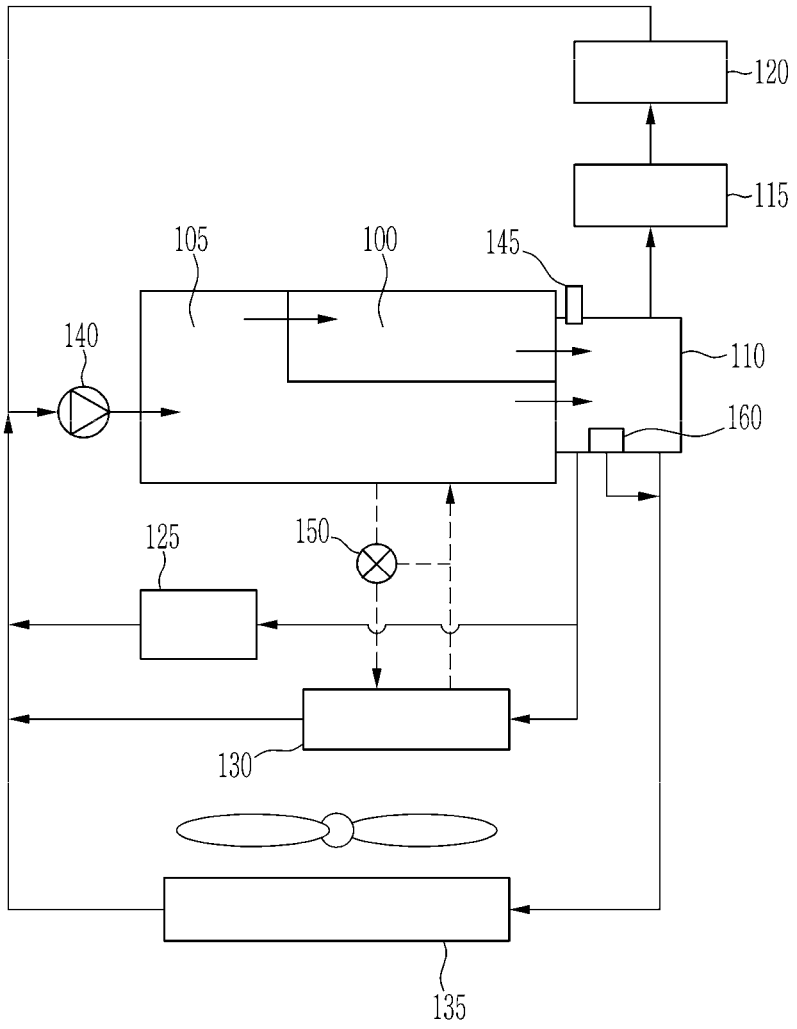
FIG. 1 is a schematic diagram illustrating an entire coolant flow in a cooling system having a coolant control valve unit according to an embodiment of the present disclosure.

An embodiment of the present disclosure is hereinafter described in detail with reference to the accompanying drawings.

The size and thickness of the parts in each configuration illustrated in the drawings may be arbitrarily illustrated for explanatory convenience. However, the present disclosure is not limited thereto, and the thicknesses may be enlarged for more apparently expressing various portions and regions.

In addition, in order to more clearly explain an embodiment of the present disclosure, a detailed description of a portion, which is not related to the disclosure, may have been omitted. Also, like reference numerals designate like or similar constituent elements throughout the specification and drawings.

Names of elements in the following description may be distinguished as "first", "second", and the like in order to distinguish the elements because the names of the elements are the same. Those elements are not particularly limited to any specific order thereof.

The following reference numbers, names, and descriptions are used throughout the drawings and the detailed description:

100: cylinder head
105: cylinder block
110: coolant control valve unit
115: low pressure EGR cooler
120: heater
125: high pressure EGR valve
130: oil cooler
135: radiator
140: coolant pump
145: coolant temperature sensor
150: bypass valve
160: fail safe valve
162: cooling portion
164: wall
166: bypass passage
168: cooling passage
170: piston rod
200: valve housing
210*a*, 201*b*, 210*c*: first, second, and third valves
215*a*, 215*b*, 215*c*: first, second, and third rods
230: head coolant supply passage
245*a*, 400, 245*c*: first, second, and third distribution passages

245*b*: block coolant supply passage
270: cam
280: coolant chamber
290: elastic member FIG. 1 is a schematic diagram illustrating an entire coolant flow in a cooling system having a coolant control valve unit according to an embodiment of the present disclosure.

Referring to FIG. 1, an engine system includes a cylinder head 100, a cylinder block 105, a coolant pump 140, a high pressure EGR valve 125, a bypass valve 150, an oil cooler 130, a radiator 135, a coolant control valve unit 110, a coolant temperature sensor 145, a low pressure EGR cooler 115, a heater 120, and a fail-safe valve 160.

The cylinder head 100 is disposed on the cylinder block 105. A combustion chamber is formed at the cylinder block 105 and intake ports and exhaust ports that are connected to the combustion chamber are formed at the cylinder head 100.

The coolant control valve unit 110 distributes coolant delivered from the cylinder head 100 and the cylinder block 105 to the low pressure EGR cooler 115, the heater 120, the radiator 135, the high pressure EGR valve 125, and the oil cooler 130.

An oil line is diverged from one side of the cylinder block 105 so that the oil is distributed to the oil cooler 130. The bypass valve 150 controls flow of the oil.

The fail-safe valve 160 bypasses overheated coolant to the radiator 135 in a state that the coolant control valve unit 110 does not operate, i.e., is fixed or stuck. Here, the fail-safe valve may have a structure of a wax type thermostat, where the thermostat has a cooling portion filled with wax. The wax contracts and expands according to a coolant temperature of the coolant to change the state of, i.e., open or close the thermostat or fail-safe valve.

In an embodiment of the present disclosure, the failsafe valve 160 provided at the coolant control valve unit 110 improves temperature sensitivity. Accordingly, stability of the coolant control valve unit and the whole cooling system may be improved in an overheated condition of the coolant in a state that the cooling control valve unit is fixed or stuck.

Figure 2:
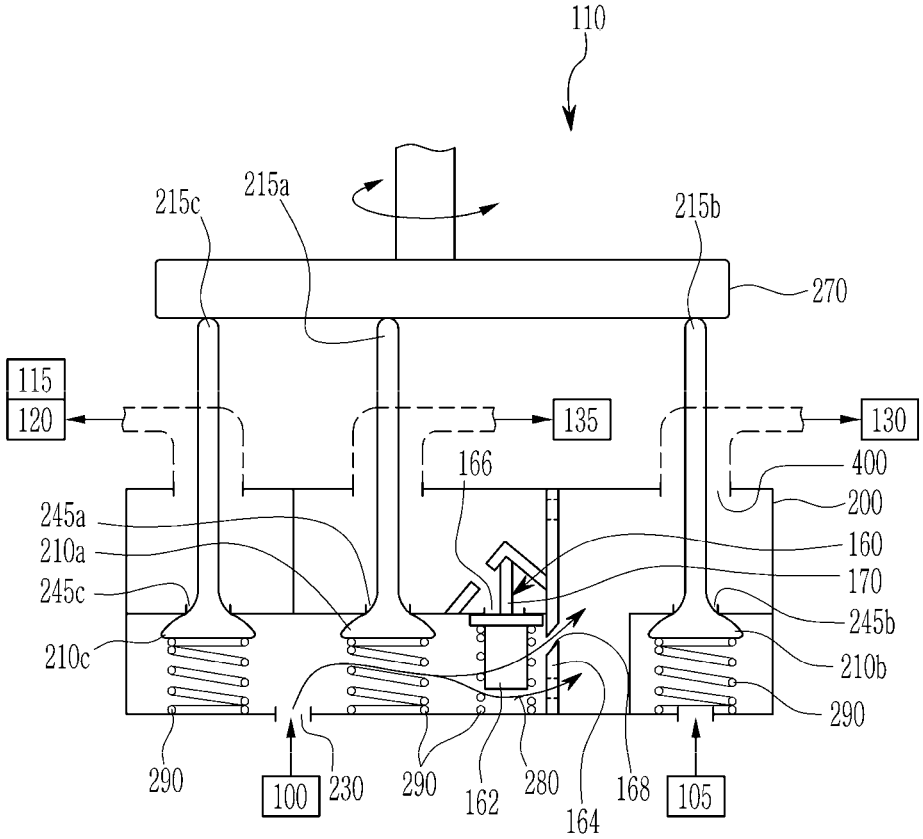
FIG. 2 is a schematic cross-sectional view of a coolant control valve unit according to an embodiment of the present disclosure.

FIG. 2 is a schematic cross-sectional view of a coolant control valve unit according to an embodiment of the present disclosure.

Referring to FIG. 2, the coolant control valve unit 110 includes a cam 270, a first rod 215*a*, a second rod 215*b*, a third rod 215*c*, a corresponding first valve 210*a*, a corresponding second valve 210*b*, a corresponding third valve 210*c*, a respective elastic member 290, a valve housing 200, a head coolant supply passage 230, and a block coolant supply passage 245*b*.

Further, the coolant control valve unit 110 includes a first distribution passage 245*a*, a second distribution passage 400, a third distribution passage 245*c*, a wall 164, a cooling passage 168, the fail-safe valve 160, a coolant chamber 280, and a bypass passage 166. Further, the fail-safe valve 160 includes a cooling portion 162 and a piston rod 170.

A valve operator (a motor or the like, not shown) rotates the cam 270. An inclined surface set on a lower surface of the cam 270 presses the upper ends of the first, second, and third rods 215*a*, 215*b*, and 215*c* toward the lower portions (downward in FIG. 2). Further, the first, second, and third valves 210*a*, 210*b*, and 210*c* may open and close the first distribution passage 245*a*, the block coolant supply passage 245*b*, and the third distribution passage 245*c*, respectively.

The third valve 210*c* is disposed on one side of the first valve 210*a* and the fail-safe valve 160 is disposed at the other side of the first valve 210*a*. The fail-safe valve 160 opens and closes the bypass passage 166.

The cooling portion 162 is disposed at a lower portion of the fail-safe valve 160 and the piston rod is disposed at an upper portion of the fail-safe valve 160. The elastic member 290 elastically supports a valve sheet (not shown) formed on an upper end of the cooling portion 162 toward the upper portion to close the bypass passage 166.

When the cooling portion 162 is heated by the coolant temperature, the wax that fills the cooling portion 162 expands. The expanded wax moves the piston rod 170 toward the upper portion. The cooling portion 162 and the valve sheet move toward the lower portion in an opposing direction of the moving direction of the piston rod 170 such that the bypass passage 166 is opened.

In an embodiment of the present disclosure, the fail-safe valve 160 has a structure of a wax type thermostat, which structure is a known technology.

The wall 164 is oriented or formed in upper and lower directions on the other side of the fail-safe valve 160, opposite the first valve 210*a*. The cooling passage 168 is formed at a position corresponding to the cooling portion 162 at and through the wall 164.

At one side of the wall, the third valve 210*c*, the first valve 210*a*, and the fail-safe valve 160 are disposed in sequence. On the other side of the wall 164, the second valve 210*b* is disposed and the second distribution passage 400 is formed on the upper side of the second valve 210*b* corresponding to the second rod 215*b*, spaced from the block coolant supply passage 254*b*.

The second distribution passage 400 is connected or communicates with the oil cooler. Coolant supplied from the cylinder head 100 or the cylinder block 105 gathers in the coolant chamber 280 in the valve housing 200. The coolant gathered in the coolant chamber 280 is constantly supplied to the oil cooler 130 through the second distribution passage 400.

The head coolant supply passage 230 is formed at the one side of the wall 164 and the second distribution passage 400 is formed at the other side. The coolant supplied to the head coolant supply passage 230 passes through the cooling portion 162 of the fail-safe valve 160 and the cooling passage 168 to flow to the second distribution passage 400.

Likewise, when the second valve 210*b* is opened, the block coolant supply passage 245*b* is opened such that the coolant supplied from the cylinder block 105 may flow to the second distribution passage 400.

The first distribution passage 245*a* is connected with the radiator 135, the third distribution passage 245*c* is connected with the heater 120 and the low pressure EGR cooler 115, and the bypass passage 166 is connected with the radiator 135.

The wall 164 separates a space in which the fail-safe valve 160 is disposed and a space in which the second rod 215*b* is disposed. The coolant may bypass a passage (no reference numbers shown) to flow to the second distribution passage 400. As illustrated in FIG. 2, passages may be formed on an upper and lower portion of the wall 164.

Figure 3:
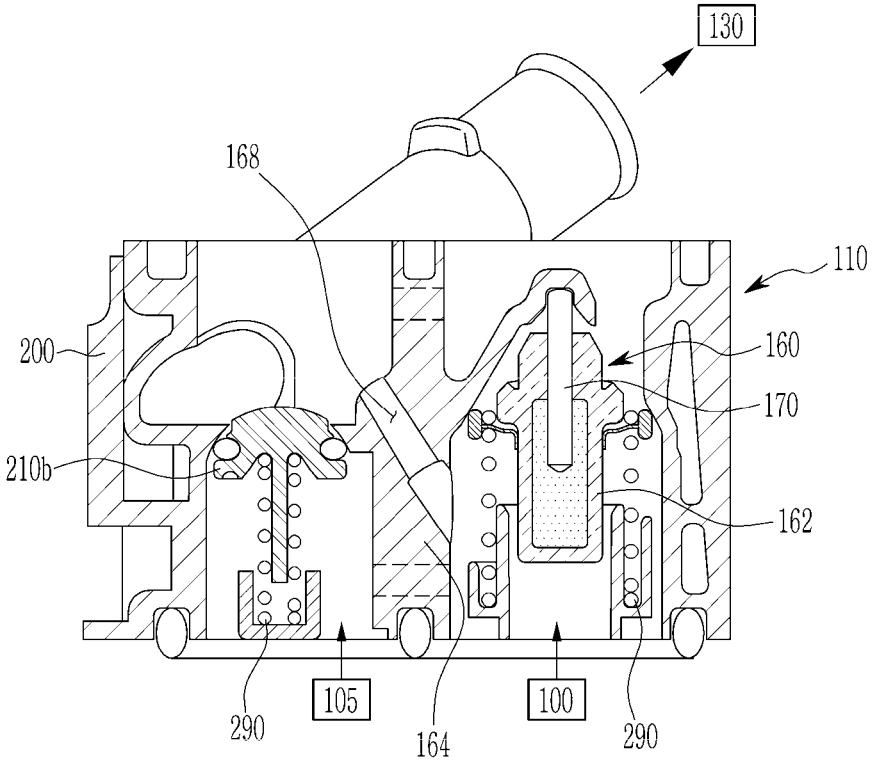
FIG. 3 is a partial cross-sectional view of a coolant control valve unit according to an embodiment of the present disclosure.

FIG. 3 is a partial cross-sectional view of a coolant control valve unit according to an embodiment of the present disclosure.

Referring to FIG. 3, the valve housing 200 is formed such that the second valve 210*b* and the fail-safe valve 160 are disposed in the valve housing 200. The second valve 210*b* is configured to open and close the block coolant supply passage 245*b*. The fail-safe valve 160 is configured to open and close the bypass passage 166.

With reference to FIG. 3, the wall 164 separates a region in which the second valve 210*b* is disposed and a region in which the fail-safe valve 160 is disposed into a right and left portion. The cooling passage 168 is formed at and through the wall 164 corresponding to the cooling portion 162 of the fail-safe valve 160. The cooling passage 168 is formed to be inclined toward an upper portion of the wall 164.

On an upper side portion of the second valve 210*b*, the second distribution passage 400 connected with the oil cooler 130 is formed. On a lower side portion of the fail-safe valve 160, the head coolant supply passage 230 to which the coolant supplied from cylinder head 100 is formed.

Accordingly, the coolant supplied to the head coolant supply passage 230 passes the cooling portion 162 of the fail-safe valve 160, the coolant passage 168 of the wall 164, and the second distribution passage 400 such that the coolant stably flows to the oil cooler 130.

In an embodiment of the present disclosure, the wall 164 separates both sides. The coolant supplied from the head coolant supply passage 230 may bypass the passage (no reference numbers shown) to flow toward the oil cooler 130.

Further, the coolant supplied from the cylinder block 105 to the lower portion of the second valve 210*b* flows toward the upper side portion through the block coolant supply passage 245*b* according to opening and closing operations of the second valve 210*b*.

Further, a portion of the coolant flowed or directed toward the upper side portion through the block coolant supply passage 245*b* passes the second distribution passage 400 to be supplied to the oil cooler 130. Further, the remaining coolant may pass the passage formed at the wall 164 or the cooling passage 168 and be supplied to the heater 120 or the radiator 135 through the first and third valves 210*a* and 210*c*.

In an embodiment of the present disclosure, the head coolant supply passage 230 may be referred to as the first supply passage and the block coolant supply passage 245*b* may be referred to as the second supply passage.

While this disclosure has been described in connection with what are presently considered to be practical embodiments, it is to be understood that the disclosure is not limited to the disclosed embodiments.

What is claimed is:

1. A coolant control valve unit comprising:

a valve housing in which a first supply passage and a second supply passage that supply coolant are formed, a coolant chamber in which coolant supplied through the first and second supply passages gathers, a first distribution passage and a second distribution passage being distributed from the coolant chamber to coolant components, and a bypass passage bypassing the first distribution passage;

first and second valves disposed to open and close the first distribution passage and the second supply passage;

a thermostat of a temperature sensitive type installed at the bypass and operating by a coolant temperature;

a valve operator controlling movement of the first and second valves respectively; and a wall formed at one side of the thermostat and in which a cooling passage is formed such that the coolant flows from the first supply passage to the second distribution passage, wherein the first distribution passage and the bypass passage are formed at one side of the wall, and the second distribution passage and the second supply passage are formed at the other side of the wall.

2. The coolant control valve unit of claim 1, wherein:

the thermostat includes a cooling portion filled with wax, the wax contracting and expanding according to a coolant temperature of the coolant, and the cooling passage is formed at a position corresponding to the cooling portion.

3. The coolant control valve unit of claim 1, wherein:

the thermostat is disposed on an upper portion of a side of the first supply passage and the second distribution passage is formed at an upper portion of the other side of the wall.

4. The coolant control valve unit of claim 3, wherein:

the second distribution passage includes a coolant control valve unit formed at the valve housing at a predetermined distance opposite the second supply passage.

5. A cooling system comprising:

a valve housing in which a head coolant supply passage to which coolant exhausted from a cylinder head is supplied, a block coolant supply passage to which coolant exhausted from a cylinder block is supplied, a coolant chamber in which coolant supplied through the cylinder head and the cylinder block gathers, a first distribution passage and a second distribution passage being distributed from the coolant chamber to coolant components, and a bypass passage bypassing the first distribution passage;

first and second valves disposed to open and close the first distribution passage and the block coolant supply passage;

a thermostat of a temperature sensitive type installed at the bypass and operating by a coolant temperature;

a valve operator controlling movement of the first and second valves, respectively; and a wall formed at one side of the thermostat and in which a cooling passage is formed such that the coolant flows from the first supply passage to the second distribution passage, wherein the first distribution passage and the bypass passage are formed at one side of the wall, and the second distribution passage and the block supply passage are formed at the other side of the wall.

6. The cooling system of claim 5, wherein:

the thermostat includes a cooling portion filled with wax, the wax contracting and expanding according to a coolant temperature of the coolant, and the cooling passage is formed at a position corresponding to the cooling portion.

7. The cooling system of claim 5, wherein:

the thermostat is disposed on an upper portion of a side of the head coolant supply passage and the second distribution passage is formed at an upper portion on the other side of the wall.

8. The cooling system of claim 7, wherein:

the second distribution passage includes a coolant control valve unit formed at the valve housing at a predetermined distance opposite the block coolant supply passage.

9. A cooling system comprising:

a valve housing in which a head coolant supply passage to which coolant exhausted from a cylinder head is supplied, a block coolant supply passage to which coolant exhausted from a cylinder block is supplied, a coolant chamber in which coolant supplied through the cylinder head and the cylinder block gathers, a first distribution passage, a second distribution passage, and a third distribution passage being distributed from the coolant chamber to coolant components, and a bypass passage bypassing the first distribution passage;

first, second, and third valves disposed to open and close the first distribution passage, the block coolant supply passage, and the third distribution passage;

a thermostat of a temperature sensitive type installed at the bypass and operating by coolant temperature;

a valve operator controlling movement of the first, second, and third valves, respectively; and a wall formed at one side of the thermostat and in which a cooling passage is formed such that the coolant flows from the first supply passage to the second distribution passage.

10. The cooling system of claim 9, wherein:

the thermostat includes a cooling portion filled with wax, the wax contracting and expanding according to temperature of the coolant, and the cooling passage is formed at a position corresponding to the cooling portion.

11. The cooling system of claim 9, wherein:

the first distribution passage and the bypass passage include a coolant control valve unit connected with a radiator.

12. The cooling system of claim 9, wherein:

the second distribution passage includes a coolant control valve unit connected with an oil cooler.

13. The cooling system of claim 9, wherein:

the third distribution passage includes a coolant control valve unit connected with a heater core or a low pressure EGR cooler.

14. The cooling system of claim 9, wherein:

the first distribution passage, the third distribution passage, and the bypass passage are formed at one side of the wall, and the second distribution passage and the block supply passage are formed at the other side of the wall.

15. The cooling system of claim 14, wherein:

the thermostat is disposed on an upper portion of a side of the head coolant supply passage and the second distribution passage is formed at an upper portion of the other side of the wall.

16. The cooling system of claim 15, wherein:

the second distribution passage includes a coolant control valve unit formed at the valve housing at a predetermined distance opposite the block coolant supply passage.

* * * * *